US005225100A

United States Patent [19]

Fry et al.

[11] Patent Number: 5,225,100

[45] Date of Patent: Jul. 6, 1993

[54] DETERGENT COMPOSITIONS

[75] Inventors: Alan J. Fry, South Wirral; Michael J. Garvey; Geoffrey Newbold, both of Wirral; Jonathon Osler; John M. Robb, both of Birkenhead; Douglas Wraige, Chester, all of England

[73] Assignee: Lever Brothers Company, Division of Conopco, Inc., New York, N.Y.

[21] Appl. No.: 728,873

[22] Filed: Jul. 12, 1991

[30] Foreign Application Priority Data

Jul. 13, 1990 [GB] United Kingdom ..... 9015504

[51] Int. Cl.[5] ..... C11D 3/08; C11D 1/02; C11D 1/37; C11D 1/83

[52] U.S. Cl. ..... 252/174.25; 252/174; 252/134; 252/140; 252/174.13; 252/91; 252/DIG. 16

[58] Field of Search ..... 252/174, 134, DIG. 16, 252/174.25, 140, 174.13, 91

[56] References Cited

U.S. PATENT DOCUMENTS

| | | | |
|---|---|---|---|
| 3,231,505 | 1/1966 | Farrar et al. | 252/138 |
| 3,951,821 | 4/1976 | Davidson | 252/134 X |
| 3,953,350 | 4/1976 | Fujino et al. | 252/94 |
| 4,219,436 | 8/1980 | Gromer et al. | 252/174 X |
| 4,370,250 | 1/1983 | Joshi | 252/174 X |
| 4,534,876 | 8/1985 | Browne | 252/174 X |
| 4,839,078 | 6/1989 | Kruse et al. | 252/174 X |

FOREIGN PATENT DOCUMENTS

| | | |
|---|---|---|
| 692881 | 7/1967 | Belgium . |
| 0318204 | 5/1989 | European Pat. Off. . |
| 0355626 | 2/1990 | European Pat. Off. . |
| 0395333 | 10/1990 | European Pat. Off. . |
| 3326459 | 1/1985 | Fed. Rep. of Germany . |
| 3827895 | 2/1990 | Fed. Rep. of Germany . |
| 2372890 | 8/1978 | France . |
| 60-015500 | 1/1985 | Japan . |
| 60-135497 | 7/1985 | Japan . |
| 60-135498 | 7/1985 | Japan . |
| 62-030197 | 2/1987 | Japan . |
| 62-030198 | 2/1987 | Japan . |
| 2-182972 | 7/1990 | Japan . |
| 850366 | 10/1960 | United Kingdom . |
| 911204 | 11/1962 | United Kingdom . |
| 983243 | 2/1965 | United Kingdom . |
| 989683 | 4/1965 | United Kingdom . |
| 1080066 | 8/1967 | United Kingdom . |
| 1438647 | 9/1976 | United Kingdom . |

OTHER PUBLICATIONS

Kirk-Othmer, *Encyclopedia of Chemical Technology*, 3rd ed. (1983), v. 22, pp. 347-360.

*Primary Examiner*—W. J. Shine
*Assistant Examiner*—Douglas J. McGinty
*Attorney, Agent, or Firm*—James J. Farrell

[57] ABSTRACT

A tablet of compacted detergent powder comprises an anionic detergent-active compound, a detergency builder, and optionally other detergent ingredients. The tablet is the compaction product of a particulate mixture of:

(a) from 2 to 40 wt % of a first particulate component comprising from 20 to 100 wt % of anionic detergent-active compound, (b) from 60 to 98 wt % of other ingredients, comprising from 0 to 3 wt % of anionic detergent-active compound.

12 Claims, No Drawings

DETERGENT COMPOSITIONS

TECHNICAL FIELD

The present invention relates to detergent compositions in the form of tablets of compacted detergent powder.

BACKGROUND AND PRIOR ART

Detergent compositions in tablet form are known in the art, as discussed below, and some products are now on the market. Tablets have several advantages over powdered products: they do not require measuring and are thus easier to handle and dispense into the washload, and they are more compact, hence facilitating more economical storage.

Detergent tablets are described, for example, in GB 911 204 (Unilever), U.S. Pat. No. 3,953,350 (Kao), JP 60 015 500A (Lion), JP 60 135 497A (Lion) and JP 60 135 498A (Lion); and are sold commercially in Spain.

Detergent tablets are generally made by compacting a detergent powder. It has proved difficult, however, to strike a balance between tablet strength and ability to disintegrate and disperse in the wash liquor. Tablets formed using only a light compaction pressure tend to crumble and break up on handling and packing; while more strongly compacted tablets may be sufficiently cohesive but will then fail to disperse to an adequate extent in the wash liquor.

This problem has proved especially acute with tablets formed by compressing spray-dried powders containing anionic detergent-active compounds; these surfactants are otherwise highly desirable because of their good detergency. As the tablet is wetted, highly viscous surfactant gel phases are formed which retard or prevent penetration of water into the tablet interior. In a conventional detergent powder consisting of a a spray-dried base in admixture with other, non-spray-dried components such as bleach, bleach activator and enzyme, anionic detergent-active compounds are normally included in the spray-dried base which constitutes the major proportion of the total powder (and hence tablet) formulation (typically 60–95 wt %). The anionic detergent-active compounds are therefore distributed uniformly and homogeneously through the spray-dried base powder, and widely distributed through the final powder; on compaction, this wide distribution persists into the resulting tablet.

It has now been found that this problem can be substantially alleviated by ensuring that any anionic detergent-active compounds present are not distributed widely through the tablet, but are concentrated in discrete domains within a continuous phase containing little or no anionic detergent-active compound.

EP 355 626A (Henkel) discloses a detergent tablet prepared by compaction of a mixture of at least two powder or granular components A and B, wherein A contains 100 wt % of all anionic detergent-active compound present and B contains 75–100 wt % of all ethoxylated nonionic detergent-active compound present. In the Example, a tablet is produced from a major proportion (50.6 wt %) of component A (a granulated base powder containing 14.42 wt % of anionic detergent-active compound), plus 15.4 wt % of component B, the balance consisting of other non-surfactant components.

DEFINITION OF THE INVENTION

The present invention accordingly provides a tablet of compacted detergent powder comprising an anionic detergent-active compound, a detergency builder, and optionally other detergent ingredients, characterised in that the tablet is the compaction product of a particulate mixture of:

(a) from 2 to 40 wt % of a first particulate component comprising from 20 to 100 wt % of anionic detergent-active compound, (b) from 60 to 98 wt % of other ingredients, comprising from 0 to 3 wt % of anionic detergent-active compound.

DETAILED DESCRIPTION OF THE INVENTION

Segregation of anionic detergent-active compound

The detergent tablet of the invention is prepared by compaction of a particulate detergent composition.

In the detergent tablet of the invention, any anionic detergent-active compound present is not distributed widely through the starting particulate composition and thus through the resulting tablet, but is concentrated in discrete domains in a continuous phase or matrix containing only low levels, and preferably substantially free, of anionic detergent-active compounds. The domains are derived from component (a), which is relatively concentrated with respect to anionic detergent-active compound, while the remainder of the composition, component (b), provides the matrix or continuous phase.

It is important that the proportions of components (a) and (b) be such that component (b) provides a substantially continuous phase while component (a) remains concentrated in discrete domains separated from one another within the matrix formed by component (b). Component (a) must not constitute more than 40 wt % of the whole, and preferably not more than 30 wt %.

For aesthetic reasons, it may be desirable for component (a) to be visually distinct. Visual distinctiveness may if desired be enhanced by including a colorant in component (a) or in component (b), or including different colorants in components (a) and (b). In some embodiments of the invention, however, component (a) may in any case be visually distinct, for example, if there is a difference in particle size; or if a fluorescer is present in one component but not the other.

Component (a)

Component (a) constitutes from 2 to 40 wt % of the tablet, and preferably from 2 to 30 wt %. Generally, the lower the concentration of anionic detergent-active compound in component (a), the higher the proportion of component (a) may be in the whole composition.

Component (a) may if desired consist substantially wholly of anionic detergent-active compound, in particulate form, for example, as dry powder, granules, flakes, marumes or noodles. The content of anionic detergent-active compound in component (a) is then generally at least 70 wt %, and component (a) preferably constitutes from 2 to 20 wt % of the tablet. Examples include linear alkylbenzene sulphonate in powder or flake form, and primary alcohol sulphate in noodle form.

Alternatively, component (a) may consist of an anionic detergent-active compound in liquid, waxy or paste form on a particulate carrier material.

A third possibility for component (a) is a detergent base powder, for example, a spray-dried or granulated detergent base powder, containing a high level (at least 20 wt %) of anionic detergent-active compound. Component (a) then preferably constitutes from 15 to 40 wt % of the tablet.

Component (a) may itself be a mixture of one or more particulate components, for example, one detergent-active compound in powder form, plus another in liquid or paste form adsorbed on a carrier; provided that the content of anionic detergent-active compound in component (a) as a whole is at least 20 wt %.

If desired, component (a) may also contain nonionic surfactants, at least in small amounts. Preferably, however, any nonionic surfactant present in the tablet is predominantly or wholly in component (b).

Component (b)

The remainder of the composition, which forms the matrix or continuous phase, has been designated as component (b). This constitutes from 60 to 98 wt %, preferably from 70 to 98 wt %, of the tablet. In general, it is likely that component (b) will itself be a mixture of ingredients. Component (b) as a whole should be particulate, but it may contain non-particulate ingredients, for example, sprayed-on liquids or pastes.

Component (b) may, for example, comprise a detergent base powder, for example, a spray-dried detergent base powder, but one that contains a low level (≦3 wt %), or is substantially free from, anionic detergent-active compounds. Any postdosed ingredients such as bleaches, bleach activators and enzymes would also form part of component (b). Alternatively, component (b) may be an aggregation of other separate ingredients which together with the anionic detergent-active compound of component (a) will add up to a dry-mixed detergent composition. Intermediate situations between these two extremes can also be envisaged.

It appears that the presence of nonionic detergent-active compounds in component (b) has no significant detrimental effect on dissolution and dispersion, at least in amounts of up to about 10 wt %. Nonionic detergent active compounds may be included by any suitable method, for example, as part of a spray-dried base, by spraying on or by admixture.

It is also within the scope of the invention for the nonionic detergent-active compound to be treated similarly to the anionic detergent-active compound, that is to say, concentrated in discrete domains, which are distinct from both components (a) and (b).

Since nonionic detergent-active compounds are generally liquids, these domains are preferably formed from any of the well known carriers in the detergent business impregnated by the nonionic detergent-active compound. Preferred carriers include zeolite; zeolite granulated with other materials, for example, Wessalith CS (Trade Mark), Wessalith CD (Trade Mark), Vegabond GB (Trade Mark); sodium perborate monohydrate; Burkeite (spray-dried sodium carbonate and sodium sulphate as disclosed in EP 221 776 (Unilever)).

Nonionic surfactants may optionally be mixed with materials which make the granules slow wetting and/or prevent the nonionic leaching out into the main tablet matrix. Such materials may suitably be fatty acids, especially lauric acid as disclosed in EP 0 342 043 (Procter & Gamble).

Bulk density

The starting particulate composition may have any bulk density. However, the invention is especially relevant to tablets made by compacting powders of relatively high bulk density, because of their greater tendency to exhibit dissolution problems. Such tablets have the advantage that, as compared with a tablet derived from a low-bulk-density powder, a given dose of detergent composition can be presented as a smaller tablet.

Thus the starting particulate composition may advantageously have a bulk density of at least 400 g/liter, preferably at least 500 g/liter, more preferably at least 700 g/liter.

Processes for producing granular detergent compositions or components of high bulk density that may be compacted to form tablets in accordance with the present invention are described and claimed in EP 340 013A (Unilever), EP 352 135A (Unilever), EP 425 277A (Unilever), EP 367 339A (Unilever) and EP 390 251A (Unilever).

However, the invention is also applicable to tablets made by compacting lower-bulk-density detergent powders prepared by conventional techniques such as spray-drying, dry-mixing, granulation and combinations of those processes.

Dispersion and dissolution

The dissolution rates of tablets of the present invention in the wash liquor were determined and compared using the following test.

A programmable 0.7 linear scale model of a front-loading automatic washing machine was filled with water (10 liters, 12° French hard) at 15° C. and the following simulated wash regime activated: the drum was rotated in a clockwise direction for 10 seconds at 60 rpm, allowed to remain stationary for 10 seconds, then rotated in an anticlockwise direction for 10 seconds, this cycle being carried out 30 times. No washload was present. Dissolution was monitored by means of conductivity measurements.

In this test, the detergent tablet of the invention is desirably capable of dissolving to an extent of 50 wt % in water at 15° C. in ≦4 minutes; and preferably capable of dissolving to an extent of 90 wt % in water at 15° C. in ≦8 minutes.

Tabletting

As previously indicated, the tablets of the invention are prepared by compaction of a granular starting material. Any suitable tabletting apparatus may be used.

For any given starting composition, the speed of disintegration and dissolution in the wash liquor will vary with the compaction pressure used to form the tablet. If the compaction pressure is too low, the tablet will tend to crumble and disintegrate in the dry state, on handling and packaging; an increase in compaction pressure will improve tablet integrity, but eventually at the expense of disintegration and dissolution time in the wash liquor.

Using an Instron (Trade Mark) Universal Testing Machine at constant speed, or a Research and Industrial screw hand press, to operate a steel punch and die, it has been found that effective tablets may be produced using compaction pressures ranging from 0.1 to 100 MPa, especially from 0.3 to 20 MPa. The optimum compaction pressure will depend to some extent on the starting composition.

As a measure of the resistance of the tablets to fracture, the diametral fracture stress $\sigma_o$ also referred to in the literature as tensile strength, was determined as follows. The tablets were compressed diametrically at a rate of 1 cm/minute between the platens of an Instron Universal Testing Machine until fracture occurred, the applied load required to cause fracture was recorded, and the diametral fracture stress $\sigma_o$ calculated from the following equation:

$$\sigma_o = \frac{2P}{\pi D t}$$

where $\sigma_o$ is the diametral fracture stress (Pa), P is the applied load to cause fracture (N), D is the tablet diameter (m) and t is the tablet thickness (m).

Tablets of the invention preferably have a diametral fracture stress of at least 5 kPa, and more preferably at least 7 kPa.

Disintegrant

Dispersion and dissolution of the tablet of the invention may be assisted further by the incorporation of a disintegrant that is capable of effecting disruption of the structure of the tablet when the tablet is immersed in water. Disruption may be by a physical mechanism, a chemical mechanism, or a combination of these.

Tablet disintegrants are well known in the pharmaceutical art and are known to act by four principle mechanisms: swelling, porosity and capillary action (wicking), and deformation (all physical), and effervescence (chemical). Tablet disintegrants in the pharmaceutical industry are reviewed by W Lowenthal, Journal of Pharmaceutical Sciences Volume 61, No. 11 (November 1972).

Physical disintegrants include organic materials such as starches, for example, corn, maize, rice and potato starches and starch derivatives, such as Primojel (Trade Mark) carboxymethyl starch and Explotab (Trade Mark) sodium starch glycolate; celluloses and cellulose derivatives, for example, Courlose (Trade Mark) and Nymcel (Trade Mark) sodium carboxymethyl cellulose, Ac-di-Sol (Trade Mark) cross-linked modified cellulose, and Hanfloc (Trade Mark) microcrystalline cellulosic fibres; and various synthetic organic polymers, notably crosslinked polyvinyl pyrrolidone, for example, Polyplasdone (Trade Mark) XL or Kollidon (Trade Mark) CL. Inorganic swelling disintegrants include bentonite clay.

Some disintegrants may additionally give a functional benefit in the wash, for example, supplementary building, antiredeposition or fabric softening.

Effervescent (chemical) disintegrants include weak acids or acid salts, for example, citric acid (preferred), maleic acid or tartaric acid, in combination with alkali metal carbonate or bicarbonate; these may suitably be used in an amount of from 1 to 25 wt %, preferably from 5 to 15 wt %. Further examples of acid and carbonate sources and other effervescent systems may be found in Pharmaceutical Dosage Forms: Tablets, Volume 1, 1989, pages 287–291 (Marcel Dekker Inc, ISBN 0-8247-8044-2).

Tablet form

The detergent tablet of the invention may be, and preferably is, formulated for use as a complete heavy-duty fabric washing composition. The consumer then does not need to use a mix of tablets having different compositions.

Although one tablet may contain sufficient of every component to provide the correct amount required for an average washload, it is convenient if each tablet contains a submultiple quantity of the composition required for average washing conditions, so that the consumer may vary the dosage according to the size and nature of the washload. For example, tablet sizes may be chosen such that two tablets are sufficient for an average washload; one or more further tablets may be added if the washload is particularly large or soiled; and one only tablet may be used if the load is small or only lightly soiled.

Alternatively, larger subdivisible tablets representing a single or multiple dose may be provided with scorings or indentations to indicate unit dose or submultiple unit dose size to the consumer and to provide a weak point to assist the consumer in breaking the tablet if appropriate.

The size of the tablet will suitably range from 10 to 160 g, preferably from 15 to 60 g, depending on the wash conditions under which it is intended to be used, and whether it represents a single dose, a multiple dose or a submultiple dose.

The tablet of the invention may be of any suitable shape, but for manufacturing and packaging convenience is preferably of uniform cross-section, for example, circular (preferred) or rectangular.

The tablet need not be homogeneous, but may consist of more than one discrete region: for example, two or more layers of different composition may be present, or a core region may be wholly surrounded by an outer region of different composition. In any one region of such a tablet, any anionic detergent-active compound present must be in the form of domains of a component (a) as previously defined, within a matrix of a component (b) as previously defined, within the percentage limits previously defined; but a component (a) need not be present in every region of the tablet. It is also within the scope of the invention for different regions of an heterogeneous tablet of this type to contain different components (a), provided that for each region the percentage limits previously defined are observed.

Detergent-active compounds

The total amount of detergent-active material in the tablet of the invention is suitably from 2 to 50 wt %, and is preferably from 5 to 40 wt %. Detergent-active material present may be anionic (soap or non-soap), cationic, zwitterionic, amphoteric, nonionic or any combination of these.

Anionic detergent-active compounds may be present in an amount of from 2 to 40 wt %, preferably from 4 to 30 wt %.

Synthetic anionic surfactants are well known to those skilled in the art. Examples include alkylbenzene sulphonates, particularly sodium linear alkylbenzene sulphonates having an alkyl chain length of $C_8$–$C_{15}$; primary and secondary alkyl sulphates, particularly sodium $C_{12}$–$C_{15}$ primary alcohol sulphates; olefin sulphonates; alkane sulphonates; dialkyl sulphosuccinates; and fatty acid ester sulphonates.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Any fatty acid soap present should be treated in the same way as synthetic anionic surfactant, and included within the various percentage ranges for anionic surfactant quoted above.

Suitable nonionic detergent compounds which may be used include in particular the reaction products of compounds having a hydrophobic group and a reactive hydrogen atom, for example, aliphatic alcohols, acids, amides or alkyl phenols with alkylene oxides, especially ethylene oxide either alone or with propylene oxide.

Specific nonionic detergent compounds are alkyl ($C_{6-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylenediamine. Other so-called nonionic detergent compounds include long-chain tertiary amine oxides, tertiary phosphine oxides, and dialkyl sulphoxides.

Especially preferred are the primary and secondary alcohol ethoxylates, especially the $C_{12-15}$ primary and secondary alcohols ethoxylated with an average of from 5 to 20 moles of ethylene oxide per mole of alcohol.

Detergency builders

The detergent tablets of the invention contain one or more detergency builders, suitably in an amount of from 5 to 80 wt % anhydrous basis, preferably from 20 to 80 wt % anhydrous basis.

The invention is of especial relevance to tablets derived from detergent compositions containing alkali metal aluminosilicates as builders, since such tablets appear to have a particular tendency to exhibit dispersion problems.

Alkali metal (preferably sodium) aluminosilicates may suitably be incorporated in amounts of from 5 to 60% by weight (anhydrous basis) of the composition, and may either crystalline or amorphous or mixtures thereof, having the general formula:

$$0.8\text{–}1.5\ Na_2O.\ Al_2O_3.0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof. Also of interest is the novel zeolite P described and claimed in our copending European Patent Application No. 89 311 284.7 filed on 1 Nov. 1989 (Case T.3047).

Other builders may also be included in the detergent tablet of the invention if necessary or desired: suitable organic or inorganic water-soluble or water-insoluble builders will readily suggest themselves to the skilled detergent formulator. Inorganic builders that may be present include alkali metal (generally sodium) carbonate; while organic builders include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates; and organic precipitant builders such as alkyl- and alkenylmalonates and succinates, and sulphonated fatty acid salts.

Especially preferred supplementary builders are polycarboxylate polymers, more especially polyacrylates and acrylic/maleic copolymers, suitably used in amounts of from 0.5 to 15 wt %, especially from 1 to 10 wt %; and monomeric polycarboxylates, more especially citric acid and its salts, suitably used in amounts of from 3 to 20 wt %, more preferably from 5 to 15 wt %.

Preferred tabletted compositions of the invention preferably do not contain more than 5 wt % of inorganic phosphate builders, and are desirably substantially free of phosphate builders. However, phosphate-built tabletted compositions are also within the scope of the invention.

Other ingredients

Tabletted detergent compositions according to the invention may also suitably contain a bleach system. This preferably comprises one or more peroxy bleach compounds, for example, inorganic persalts or organic peroxyacids, which may be employed in conjunction with activators to improve bleaching action at low wash temperatures.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The novel quaternary ammonium and phosphonium bleach activators disclosed in U.S. Pat. No. 4,751,015 and U.S. Pat. No. 4,818,426 (Lever Brothers Company) are also of great interest. The bleach system may also include a bleach stabiliser (heavy metal sequestrant) such as ethylenediamine tetramethylene phosphonate and diethylenetriamine pentamethylene phosphonate. The skilled detergent worker will have no difficulty in applying the normal principles of formulation to choose a suitable bleach system.

The detergent tablets of the invention may also contain one of the detergency enzymes well-known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), Esperase (Trade Mark) and Savinase (Trade-Mark), as supplied by Novo Industri A/S, Copenhagen, Denmark. Detergency enzymes are commonly employed in the form of granules or marumes, optionally with a protective coating, in amounts of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'- bis-(phenyl-styryl) disulphonate.

An antifoam material is advantageously included in the detergent tablet of the invention, especially if the tablet is primarily intended for use in front-loading drum-type automatic washing machines. Suitable antifoam materials are usually in granular form, such as those described in EP 266 863A (Unilever). Such antifoam granules typically comprise a mixture of silicone oil, petroleum jelly, hydrophobic silica and alkyl phosphate as antifoam active material, sorbed onto a porous absorbent water-soluble carbonate-based inorganic carrier material. Antifoam granules may be present in any amount up to 5% by weight of the composition.

It may also be desirable to include in the detergent tablet of the invention an amount of an alkali metal silicate, particularly sodium ortho-, meta- or preferably neutral or alkaline silicate. The presence of such alkali metal silicates at levels, for example, of 0.1 to 10 wt %, may be advantageous in providing protection against the corrosion of metal parts in washing machines, besides providing some measure of building and giving processing benefits.

Further ingredients which can optionally be employed in the detergent tablet of the invention include antiredeposition agents such as sodium carboxymethylcellulose, straight-chain polyvinyl pyrrolidone and the cellulose ethers such as methyl cellulose and ethyl hydroxyethyl cellulose; fabric-softening agents; heavy metal sequestrants such as EDTA; perfumes; pigments, colorants or coloured speckles; and inorganic salts such as sodium and magnesium sulphate. Sodium sulphate may if desired be present as a filler material in amounts up to 40% by weight of the composition; however as little as 10% or less by weight of the composition of sodium sulphate, or even none at all, may be present.

As well as the functional detergent ingredients listed above, there may be present various ingredients specifically to aid tabletting, for example, binders and lubricants. Tablet binders include natural gums (for example, acacia, tragacanth) and sugars (for example, glucose, sucrose). Tablet lubricants include calcium, magnesium and zinc soaps (especially stearates), talc, glyceryl behapate, Myvatex (Trade Mark) TL ex Eastman Kodak, sodium benzoate, sodium acetate, polyethylene glycols and colloidal silicas (for example, Alusil (Trade Mark) ex Crosfield Chemicals Ltd).

As indicated previously, some ingredients may give both functional wash benefits and tabletting benefits.

EXAMPLES

The following non-limiting Examples illustrate the invention. Parts and percentages are by weight unless otherwise stated. Examples identified by numbers are in accordance with the invention, while those identified by letters are comparative.

EXAMPLE 1

A spray-dried base powder free of anionic surfactant was prepared, and other ingredients admixed, to the following formulation:

| | % |
|---|---|
| Spray-dried base | |
| Nonionic surfactant 7EO | 4.5 |
| Zeolite 4A (anhydrous basis) | 37.0 |
| Acrylate/maleic anhydride copolymer | 5.0 |
| Sodium carbonate | 14.0 |
| Nonionic surfactant 3EO (sprayed on) | 4.0 |
| Minors and water | 11.8 |
| Admixed | |
| Na primary alcohol sulphate (89 wt % noodles) | 6.7 |
| Sodium perborate monohydrate | 7.5 |
| TAED (83 wt % granules) | 4.5 |
| Dequest 2047 (33 wt % granules) | 0.5 |
| Antifoam granules | 4.0 |
| Perfume | 0.5 |
| | 100.0 |

The bulk density of the final powder was 700 g/liter.

In this composition, component (a) consisted of the primary alcohol sulphate noodles, which contained 89 wt % active matter and constituted 6.7 wt % of the total composition. Component (b) was constituted by the sum total of all other ingredients.

EXAMPLE 2

A spray-dried powder free of anionic surfactant was prepared as indicated below and 1.0% acrylate/maleic anhydride copolymer (sodium salt) was sprayed onto the base powder, before admixing the other ingredients.

| | % |
|---|---|
| Spray-dried base | |
| Nonionic surfactant 7EO | 4.5 |
| Zeolite 4A (anhydrous basis) | 37.0 |
| Sodium carbonate | 14.9 |
| Nonionic surfactant 3EO (sprayed on) | 4.0 |
| Acrylate/maleic anhydride copolymer | 5.0 |
| Sodium carboxymethyl cellulose (SCMC) | 0.5 |
| Fluorescers | 0.2 |
| Water | 10.4 |
| Admixed | |
| Na primary alcohol sulphate (89 wt % noodles) | 6.5 |
| Sodium perborate monohydrate | 7.5 |
| TAED (83% wt % granules) | 4.5 |
| Dequest 2047 (33 wt % granules) | 0.5 |
| Antifoam granules | 4.0 |
| Perfume | 0.5 |
| | 100.0 |

The bulk density of the final powder was 600 g/liter. In this composition, component (a) consisted of the primary alcohol sulphate noodles, which contained 89 wt % active matter and constituted 6.5 wt % of the total composition. Component (b) was constituted by the sum total of the other ingredients.

EXAMPLE 3

A dry mixed powder was prepared to the following formulation:

| | % |
|---|---|
| Na linear alkylbenzene sulphonate (79 wt % flakes) | 7.6 |
| Nonionic surfactant 7EO | 3.3 |
| Nonionic surfactant 3EO | 4.0 |
| *Zeolite 4A granules (74.7 wt %) | 49.5 |
| Acrylate/maleic anhydride copolymer (92 wt % powder) | 5.4 |
| Sodium carbonate | 14.7 |
| Sodium perborate monohydrate | 7.5 |
| TAED (83 wt % granules) | 4.5 |
| Dequest 2047 (33 wt % granules) | 0.5 |

-continued

| | |
|---|---|
| Antifoam granules | 2.0 |
| Perfume | 0.5 |
| Minors | 0.5 |
| | 100.0 |

*The zeolite granules were spray-dried and had the following composition:

| | |
|---|---|
| Zeolite | 74.7 |
| Sodium sulphate | 2.8 |
| Sodium carboxymethyl cellulose | 2.0 |
| Nonionic surfactant 7EO | 2.0 |
| Fluorescer | 0.027 |
| Sodium hydroxide | 0.8 |
| Water | balance |

The bulk density of the final powder was 630 g/liter.

In the composition of Example 3, component (a) consisted of the alkylbenzene sulphonate flakes, which contained 79 wt % active matter and constituted 7.6 wt % of the total composition. Component (b) was constituted by the sum total of all other ingredients.

EXAMPLE 4

A dry mixed powder was prepared to the following formulation:

| | % |
|---|---|
| Na primary alcohol sulphate (89 wt % noodles) | 6.7 |
| Zeolite/nonionic adjunct granules** | 29.9 |
| Zeolite 4A granules (74.7 wt %)* | 29.1 |
| Acrylate/maleic anhydride copolymer (92 wt % powder) | 5.4 |
| Sodium perborate monohydrate | 7.5 |
| TAED (83 wt % granules) | 4.5 |
| Dequest 2047 (33 wt % granules) | 0.5 |
| Antifoam granules | 4.0 |
| Perfume | 0.5 |
| Sodium carbonate | 11.9 |
| | 100.0 |

*The zeolite granules were spray-dried and had the composition given in Example 3.

** The zeolite/nonionic adjunct had the following composition:

| | % |
|---|---|
| Zeolite 4A | 51.0 |
| Sodium sulphate | 3.6 |
| Sodium carboxymethyl cellulose (SCMC) | 1.4 |
| Nonionic surfactant 7EO | 1.4 |
| Nonionic surfactant 3EO | 27.0 |
| Pristerine 4911 (hardened tallow fatty acid) | 1.4 |
| Fluorescer | 0.02 |
| Water | to balance |

The bulk density of the final powder was 700 g/liter.

In the composition of Example 4 component (a) consisted of the primary alcohol sulphate flakes which contained 89 wt % active matter and constituted 6.7 wt % of the total composition. Component (b) was constituted by the sum total of all the other ingredents except the nonionic detergent active. This was segregated from both components (a) and (b) via the zeolite adjunct.

EXAMPLE 5

A dry mixed powder was prepared to the following formulation:

| | % |
|---|---|
| Na primary alcohol sulphate (89 wt % noodles) | 6.7 |
| Nonionic surfactant 7EO | 3.3 |
| Nonionic surfactant 3EO | 4.0 |
| Zeolite 4A granules (as in Example 2) | 49.5 |

-continued

| | % |
|---|---|
| Acrylate/maleic anhydride copolymer (92 wt % powder) | 5.4 |
| Sodium carbonate | 13.6 |
| Sodium perborate monohydrate | 7.5 |
| TAED (83 wt % granules) | 4.5 |
| Dequest 2047 (33 wt % granules) | 0.5 |
| Antifoam granules | 4.0 |
| Perfume | 0.5 |
| Minors | 0.5 |
| | 100.0 |

The bulk density of the final powder was 50 g/liter.

In the composition of Example 5, component (a) consisted of the primary alcohol sulphate noodles, which contained 89 wt % active matter and constituted 6.7 wt % of the total composition. Component (b) was constituted by the sum total of all other ingredients.

EXAMPLE 6

A first spray-dried base powder (i) containing a high proportion of anionic detergent-active compound was prepared to the following formulation:

| | % |
|---|---|
| Na linear alkylbenzene sulphonate | 22.0 |
| Nonionic surfactant 18EO | 2.0 |
| Zeolite 4A (anhydrous basis) | 25.0 |
| Acrylate/maleic anhydride copolymer | 5.0 |
| Sodium carbonate | 10.0 |
| Sodium sulphate | 20.0 |
| Sodium silicate | 3.0 |
| Minors and water | to 100.0 |

A second spray-dried base powder (ii) free of anionic surfactant was prepared to the following formulation:

| | % |
|---|---|
| Nonionic surfactant 7EO | 5.8 |
| Zeolite 4A (anhydrous basis) | 48.0 |
| Acrylate/maleic anhydride copolymer | 6.5 |
| Sodium carbonate | 19.3 |
| Nonionic surfactant 3EO (sprayed on) | 5.2 |
| Minors and water | to 100.0 |

The two base powders were mixed together and with other ingredients to give a final formulation having a bulk density of 590 g/liter:

| | % |
|---|---|
| Base powder (i) | 27.3 |
| Base powder (ii) | 57.2 |
| Sodium perborate monohydrate | 7.5 |
| TAED (83 wt % granules) | 4.5 |
| Dequest 2047 (33 wt % granules) | 0.5 |
| Antifoam granules | 2.0 |
| Perfume | 0.5 |
| Coloured speckles (sodium carbonate) | 0.5 |
| | 100.0 |

In this composition, component (a) consisted of the base powder (i), which contained 22.0 wt % anionic detergent-active compound (linear alkylbenzene sulphonate) and constituted 27.3 wt % of the total composition. Component (b) was constituted by the sum total of all other ingredients.

EXAMPLE 7

A spray-dried base powder free of anionic surfactant (soap) was prepared, and other ingredients admixed, to the following formulation:

| | |
|---|---|
| Spray-dried base | |
| Nonionic surfactant 7EO | 4.5 |
| Zeolite 4A (anhydrous basis) | 37.0 |
| Acrylate/maleic anhydride copolymer | 5.0 |
| SCMC | 0.5 |
| Fluorescers | 0.2 |
| Nonionic surfactant 3EO | 4.0 |
| Water and minors | 11.0 |
| Admixed | |
| Soap noodles[5] (83 wt % anhydrous noodles) | 7.0 |
| Sodium perborate monohydrate | 4.5 |
| Dequest 2047 (33 wt % granules) | 0.5 |
| Sodium carbonate | 15.8 |
| Antifoam granules | 2.0 |
| Perfume | 0.5 |
| | 100.0 |

[5]Sodium salt noodles containing 82/18 tallow/coconut fatty acids blend (noodles were up to 5 mm in length and approximately 0.75 mm in width).

The bulk density of the final powder was 670 g/liter. In this composition, component (a) consisted of the soap noodles, which contained 83 wt % active matter and constituted 7 wt % of the total composition. Component (b) was constituted by the sum of the total of all other ingredients.

COMPARATIVE EXAMPLE A

A spray-dried base powder containing anionic surfactant was prepared, and other ingredients admixed, to the following formulation:

| | % |
|---|---|
| Spray-dried base | |
| Na linear alkylbenzene sulphonate | 7.0 |
| Nonionic surfactant 7EO | 3.2 |
| Fatty acid soap | 1.8 |
| Zeolite 4A (anhydrous basis) | 27.5 |
| Acrylate/maleic anhydride copolymer | 4.2 |
| Sodium carbonate | 10.2 |
| Minors and water | 15.98 |
| Nonionic surfactant 3EO (sprayed on) | 6.9 |
| | 69.89 |
| Admixed | |
| Sodium perborate monohydrate | 15.0 |
| TAED (83 wt % granules) | 6.0 |
| Dequest 2047 | 0.8 |
| Antifoam granules | 1.2 |
| Perfume | 0.22 |
| | 100.00 |

The bulk density of the final powder was 570 g/liter. This composition was outside the invention, because the anionic surfactant was present at a concentration of only 10 wt % (7 wt % in the total composition) excluding soap, or 12.6 wt % (8.8 wt % in the total composition) including soap, in a powder component constituting substantially more than 40 wt % (69.88 wt %) of the whole composition.

COMPARATIVE EXAMPLE B

A spray-dried base powder containing anionic surfactant was prepared, and other ingredients admixed, to the following formulation:

| | % |
|---|---|
| Spray-dried base | |
| Na linear alkylbenzene sulphonate | 6.0 |
| Nonionic surfactant 7EO | 4.5 |
| Zeolite 4A (anhydrous basis) | 37.0 |
| Acrylate/maleic anhydride copolymer | 5.0 |
| Sodium carbonate | 14.9 |
| Minors and water | 11.7 |
| Nonionic surfactant 3EO (sprayed on) | 4.0 |
| | 83.10 |
| Admixed | |
| Sodium perborate monohydrate | 7.5 |
| TAED (83 wt % granules) | 4.5 |
| Dequest 2047 | 0.5 |
| Granular sodium carbonate | 1.9 |
| Antifoam granules | 2.0 |
| Perfume | 0.5 |
| | 100.00 |

The bulk density of the final powder was 580 g/liter. This composition was outside the invention, because the anionic surfactant (sodium linear alkylbenzene sulphonate) was present at a concentration of only 7.2 wt % (6 wt % in the total composition), in a powder component constituting substantially more than 40 wt % (83.10 wt %) of the whole composition.

COMPARATIVE EXAMPLE C

A spray-dried base powder containing anionic surfactant was prepared, and other ingredients admixed, to the following formulation:

| | % |
|---|---|
| Spray-dried base | |
| Na linear alkylbenzene sulphonate | 7.9 |
| Sodium sulphate | 13.5 |
| Zeolite 4A (anhydrous basis) | 19.6 |
| Acrylate/maleic anhydride copolymer | 3.1 |
| Minors and water | 6.9 |
| | 51.0 |
| Admixed | |
| Zeolite/nonionic adjunct** | 15.0 |
| Sodium perborate monohydrate | 7.5 |
| TAED (83 wt % granules) | 4.5 |
| Dequest 2047 | 0.5 |
| Antifoam granules | 2.0 |
| Perfume | 0.5 |
| Sodium carbonate | 19.0 |
| | 100.0 |

The bulk density of the final powder was 660 g/liter.
**The zeolite/nonionic adjunct had the same composition given in Example 4.

This composition was outside the invention, because the anionic surfactant was present at a concentration of only 15.5 wt % (7.9 wt % in the total composition, in a powder component constituting substantially more than 40 wt % (51%) of the whole composition.

COMPARATIVE EXAMPLE D

A spray dried base powder containing anionic surfactant (soap) was prepared, and other ingredients admixed, to the following formulation:

| | % |
|---|---|
| Spray-dried base | |
| Sodium soap | 7.2 |
| Nonionic surfactant 7EO | 4.4 |
| Zeolite 4A | 30.8 |
| Sodium citrate | 4.4 |

-continued

| | % |
|---|---|
| Nonionic surfactant 3EO | 6.6 |
| Minors and water | 12.8 |
| | 66.2 |
| Admixed | |
| Sodium perborate monohydrate | 14.0 |
| TAED (83 wt % granules) | 7.4 |
| Sodium carbonate | 10.0 |
| Dequest 2047 (33 wt % granules) | 0.8 |
| Enzymes granules (savinase 6.OT:Lipolase 100T, 1.1:0.2) | 1.3 |
| Perfume | 0.3 |
| | 100.0 |

Sodium soap contained a fatty acid soap blend of 10.4/54.6/35.0 Tallow/palm kernel/oleic acids.

The bulk density of the final powder was 700 g/liter. This composition was outside the invention, because the anionic surfactant (soap) was present at a concentration of only 10.9 wt % (7.2 wt % of the total composition) in a powder component constituting substantially more than 40 wt % (66.2 wt %) of the whole composition.

Tablet preparation

Detergent tablets were prepared by compaction of the detergent powder formulations of Examples 1 to 7 and Comparative Examples A to D, at the compaction pressures shown in the following Table. The compaction pressures used were sufficient to produce a diametral fracture stress of at least 5kPa which was determined as described earlier. The actual diametral fracture stresses obtained are shown in the Table. The tablets of Examples 1 to 3, 5 and Comparative Example B were produced using a Research and Industrial screw hand press to operate a steel punch and 50 mm die. Examples 4 and 7 were produced using the same process with a 54 mm die, while the tablets of Comparative Example A, C and D were produced using the Instron Universal Testing Machine at constant speed to operate a steel punch and 54 mm die.

Each tablet contained 40 g of the relevant formulation, and was of cylindrical form, having a diameter of 50 mm or 54 mm depending on the die used: tablet thicknesses were about 1.5 to 2 cm.

Determination of tablet properties

The times taken for dissolution in water at 15° C. to 50 and 90 wt % were determined using the simulated washing machine test described earlier, and are shown in the Table.

EXAMPLES 1 TO 5, COMPARATIVE EXAMPLES A AND B

| Example | Diametral fracture stress (kPa) | Pressure (MPa) | $t_{50}$ (min) | $t_{90}$ (min) |
|---|---|---|---|---|
| 1 (i) | 6.1 | 10.2 | 2.5 | 4.3 |
| (ii) | 13.6 | 15.2 | 2.8 | 5.7 |
| 2 (i) | 8.3 | 0.4 | — | 2.8 |
| (ii) | 13.4 | 0.58 | — | 2.5 |
| (iii) | 17.2 | 0.8 | — | 5.0 |
| 3 | 17.1 | 5.1 | 4.0 | 6.2 |
| 4 (i) | 11.1 | 6.5 | 2.5 | 4.6 |
| (ii) | 13.1 | 8.7 | 3.6 | 6.5 |
| 5 (i) | 5.2 | 5.1 | 1.8 | 5.0 |
| (ii) | 11.3 | 10.2 | 3.0 | 7.4 |
| 6 | 6.5 | 2.6 | 3.0 | 6.0 |
| 7 (i) | 8.4 | 6.5 | 2.4 | 4.6 |
| (ii) | 11.4 | 8.7 | 2.3 | 5.6 |
| (iii) | 14.5 | 10.9 | 2.1 | 6.0 |
| A | 7.9 | 0.9 | 13.0 | 30.0 |
| B | 7.9 | 15.2 | 5.1 | 12.3 |
| C (i) | 14.2 | 3.9 | 5.5 | 13.5 |
| D (i) | 14.5 | 1.3 | 6.4 | 14.5 |

We claim:

1. A tablet of compacted detergent powder comprising an anionic detergent-active compound, 5 to 80 wt % (anhydrous basis) of alkali metal aluminosilicate, wherein the tablet is the compaction product of a particulate mixture of:

(a) from 2 to 40 wt % of a first particulate component comprising from 20 to 100 wt % (of component (a)) of anionic detergent-active compound, (b) from 60 to 98 wt % of other ingredients, comprising from 0 to 3 wt. % (of component (b)) of anionic detergent-active compound; and (c) other compatible detergent ingredients.

2. A detergent tablet as claimed in claim 1, wherein the first particulate component (a) constitutes from 2 to 30 wt % of the tablet.

3. A detergent tablet as claimed in claim 1, wherein the first particulate component (a) comprises at least 70 wt % of anionic detergent-active compound and is in powder, granular, flake or noodle form.

4. A detergent tablet as claimed in claim 3, wherein the first particulate component (a) constitutes from 2 to 20 wt % of the tablet.

5. A detergent tablet as claimed in claim 1, wherein the first particulate component (a) comprises an anionic detergent-active compound in liquid, waxy or paste form on a particulate carrier material.

6. A detergent tablet as claimed in claim 1, wherein the first particulate component (a) comprises a detergent base powder comprising at least 20 wt % of anionic detergent-active compound, and constitutes from 15 to 40 wt % of the tablet.

7. A detergent tablet as claimed in claim 1, wherein the first particulate component (a) is visually distinct.

8. A detergent tablet as claimed in claim 1, wherein in addition to components (a) and (b) the tablet contains nonionic detergent-active compound concentrated in discrete domains.

9. A detergent tablet as claimed in claim 1, which includes a disintegrant capable, when the tablet is immersed in water, of disrupting the structure of the tablet by swelling or effervescence.

10. A detergent tablet as claimed in claim 1, which is capable of dissolving to an extent of 50 wt % in water at 15° C. in a washing machine test in ≦4 minutes.

11. A detergent tablet as claimed in claim 1, which is capable of dissolving to an extent of 90 wt % in water at 15° C. in a washing machine test in ≦8 minutes.

12. A detergent tablet as claimed in claim 1, having a diametral fracture stress of at least 5.0 kPa.

* * * * *